US008353397B2

(12) United States Patent
Trapp et al.

(10) Patent No.: US 8,353,397 B2
(45) Date of Patent: Jan. 15, 2013

(54) PRODUCT PACKAGING WITH RELEASABLE FASTENER

(75) Inventors: Timothy J Trapp, Orchard Park, NY (US); Robert Michael Buresch, Strykersville, NY (US); Donald George Scheffold, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 373 days.

(21) Appl. No.: 12/574,979

(22) Filed: Oct. 7, 2009

(65) Prior Publication Data

US 2010/0089787 A1 Apr. 15, 2010

Related U.S. Application Data

(63) Continuation-in-part of application No. 12/249,235, filed on Oct. 10, 2008, now abandoned.

(51) Int. Cl.
*B65D 73/00* (2006.01)

(52) U.S. Cl. ..... 206/1.5; 206/493; 206/480; 411/349

(58) Field of Classification Search ..... 206/764, 206/765, 335, 477, 493, 480; 411/349, 543, 411/549, 552; 24/663, 297, 458, 453
See application file for complete search history.

(56) References Cited

U.S. PATENT DOCUMENTS 2,191,780 A 2/1940 Tinnerman et al.
2,620,539 A 12/1952 Poupitch
(Continued)

FOREIGN PATENT DOCUMENTS

FR 2233243 1/1975
(Continued)

OTHER PUBLICATIONS

Search Report for International Patent Appln. PCT/US2009/059925 dated Nov. 25, 2009.

*Primary Examiner* — David Fidei
(74) *Attorney, Agent, or Firm* — Edell, Shapiro & Finnan, LLC

(57) ABSTRACT

A fastener system includes a toy product, a support platform, and a plug that engages a keyhole formed into the product. The plug includes a base and a pronged key extending from the base. The support platform includes a through-hole that permits the passage of the key into the packaging. One or more integrally-formed biasing members are located on the base of the plug to draw the key toward the product and create a secure connection. The pronged key may be formed from a plastic material and configured such that it plastically deforms but remains attached to the key when and predetermined force is applied to the key to pull the key from a misaligned position with respect to the key hole. The key may also be formed as two prongs, each of the prongs including a first portion positioned transversely with respect to the shaft and a second, canted, portion extending between the first portion of the prong and the distal end of the shaft, the canted portions of the prongs intersecting at a line proximate the distal end of the shaft, such that the prongs deform or move towards one another along the intersecting line but remain attached to the plug when and force of at least about 20 pounds is applied to the plug to pull the plug and prongs from a misaligned position with respect to the keyhole.

20 Claims, 8 Drawing Sheets

U.S. PATENT DOCUMENTS

| | | | | |
|---|---|---|---|---|
| 3,121,273 | A | 2/1964 | Duffy et al. | |
| 3,335,471 | A | 8/1967 | Seckerson et al. | |
| D209,171 | S | 11/1967 | Myatt | |
| 3,407,454 | A | 10/1968 | Myatt et al. | |
| 3,449,799 | A * | 6/1969 | Bien | 411/548 |
| 3,674,138 | A | 7/1972 | Gilmour | |
| 3,811,565 | A | 5/1974 | Tancredi et al. | |
| 3,815,182 | A * | 6/1974 | Guard et al. | 24/453 |
| 3,816,882 | A | 6/1974 | Maeda et al. | |
| 3,963,123 | A | 6/1976 | Beal | |
| 3,990,131 | A | 11/1976 | Okamura | |
| 4,117,928 | A | 10/1978 | Schenk | |
| 4,185,739 | A | 1/1980 | Wilford | |
| 4,262,394 | A | 4/1981 | Wright | |
| 4,285,103 | A | 8/1981 | Inamoto | |
| 4,470,178 | A | 9/1984 | Matsui | |
| 4,524,494 | A * | 6/1985 | Sato et al. | 24/453 |
| 4,657,462 | A | 4/1987 | Hoen | |
| 4,682,690 | A | 7/1987 | Tiffany | |
| 4,865,097 | A | 9/1989 | Allen | |
| 5,018,253 | A | 5/1991 | Oppenheimer | |
| 5,289,916 | A | 3/1994 | Mickelberg | |
| 5,368,427 | A | 11/1994 | Pfaffinger | |
| 5,411,138 | A | 5/1995 | Klawiter | |
| 5,501,330 | A | 3/1996 | Betts | |
| 5,896,991 | A | 4/1999 | Hippely et al. | |
| 5,897,278 | A | 4/1999 | Frattarola | |
| 6,237,970 | B1 | 5/2001 | Joannou | |
| 6,425,482 | B1 | 7/2002 | Chiang | |
| 6,575,682 | B1 | 6/2003 | Dohm et al. | |
| 6,735,819 | B2 | 5/2004 | Iverson et al. | |
| 6,769,853 | B2 | 8/2004 | Perrot | |
| 6,988,863 | B2 | 1/2006 | Hulin et al. | |
| 7,328,489 | B2 | 2/2008 | Leverger et al. | |
| 7,955,038 | B2 | 6/2011 | Silbereisen et al. | |
| 2005/0269235 | A1 | 12/2005 | Lam | |
| 2010/0089788 | A1 * | 4/2010 | Trapp | 206/493 |
| 2010/0272540 | A1 | 10/2010 | Bücker et al. | |
| 2011/0253579 | A1 | 10/2011 | Chong et al. | |
| 2012/0006713 | A1 * | 1/2012 | Trapp et al. | 206/493 |

FOREIGN PATENT DOCUMENTS

| | | |
|---|---|---|
| GB | 1137395 | 12/1968 |
| GB | 2201826 | 9/1998 |

* cited by examiner

PRODUCT PACKAGING WITH RELEASABLE FASTENER

CROSS REFERENCE TO RELATED APPLICATIONS

This application is a continuation-in-part of U.S. Non-provisional application Ser. No. 12/249,235, entitled "Product Packaging with Releasable Fastener" and filed on 10 Oct. 2008, the disclosure of which is hereby incorporated by reference in its entirety.

FIELD OF THE INVENTION

The present invention is directed toward product packaging and, in particular, to toy product packing including a releasable, reusable product fastener.

BACKGROUND OF THE INVENTION

Products such as toys are generally placed in packaging that provides protection to the toy, as well as and provides a means to easily display the toy. The toys are often held in the packaging by wire tie elements, which surround the toy and are twisted together to hold the toy in place in the packaging. This design works for small toys; however, large toys require a significant amount of wire and, because of the shape of the toys, it may not be practical to place the wire around the toy to retain it in its packaging. In addition, removal of such a large amount and number of wire tie elements is tedious and time-consuming. Thus, it is desirable to create a fastening system that secures a product within its packaging, but is easily manipulated by a user to remove the product therefrom.

SUMMARY OF THE INVENTION

A fastener system for product packaging is disclosed. The system includes a product, a support platform, and a plug that engages a keyhole formed into the product. The plug includes a base and a key extending from the base. The support platform includes a through-hole that permits the passage of the key into the packaging. In operation, a product is oriented on one side of the support platform, and the plug is oriented on an opposite side of the support platform. The key is inserted though the packaging (via the through-hole), and into the keyhole formed in the product. The key is then rotated to misalign its fingers with the openings in the keyhole, preventing the key's exit from the keyhole. Biasing members located on the base of the plug draw the key toward the product to create a secure connection. With this configuration, a product may be secured within packaging without the use of wire tie fasteners.

BRIEF DESCRIPTION OF THE DRAWINGS

FIG. 2A illustrates an isolated, top perspective view of a plug component of the fastening system in accordance with an embodiment of the present invention. FIG. 2B illustrates a bottom perspective view of the plug of FIG. 2A.

FIG. 4A illustrates a side view of the product wall, while FIG. 4B illustrates an interior view of the product wall of FIG. 4A.

FIG. 9A illustrates an isolated, top perspective view of a plug component of the fastening system in accordance with an alternate embodiment of the present invention, while FIG. 9B illustrates a top perspective view of a plug component of the fastening system in accordance with yet another alternate embodiment of the present invention.

Like reference numerals have been used to identify like elements throughout this disclosure.

DETAILED DESCRIPTION OF THE INVENTION

Figure 1:
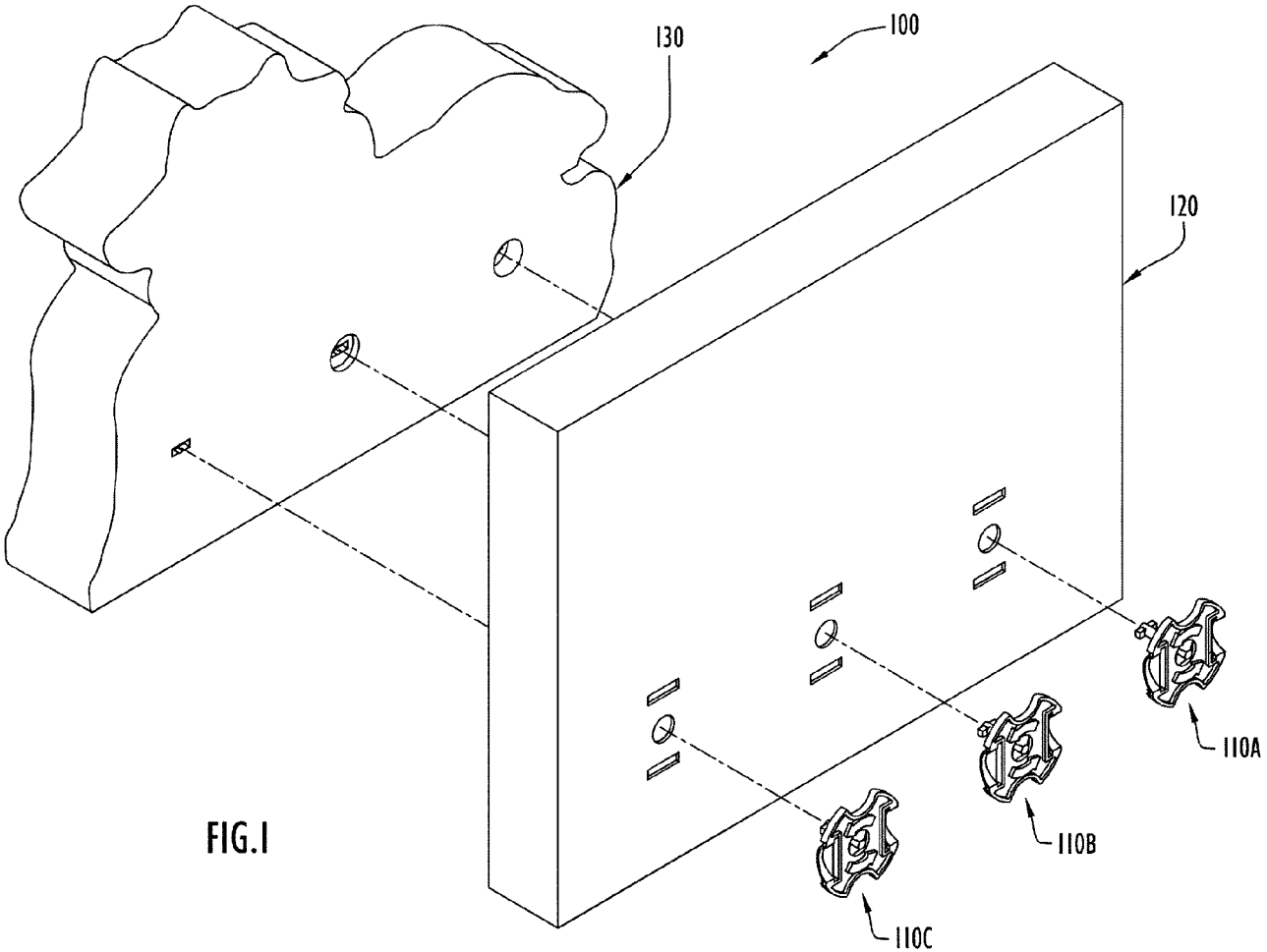
FIG. 1 illustrates an exploded view of a product fastening system in accordance with an embodiment of the present invention.
Figure 2A:
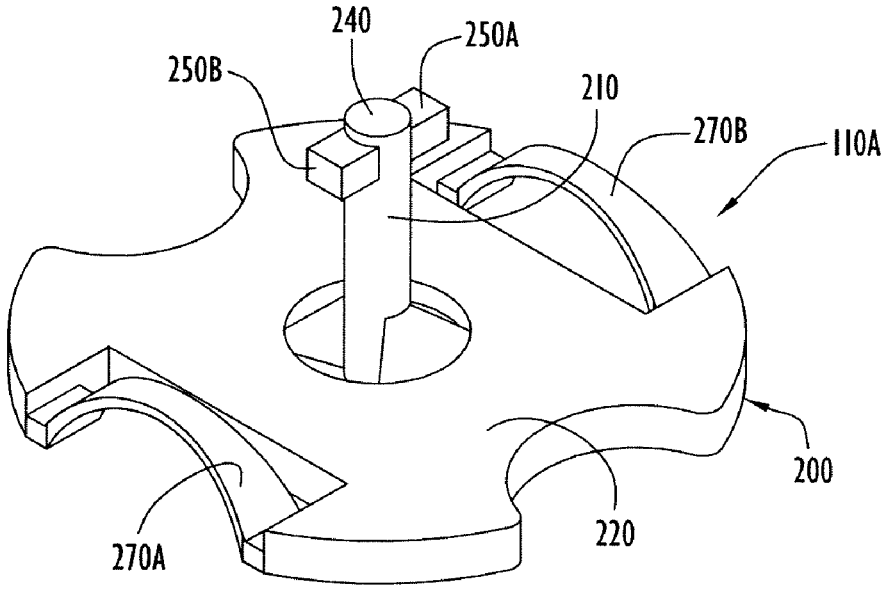
FIGS. 2A and 2B illustrate a plug in accordance with embodiments of the present invention. Specifically.
Figure 2B:
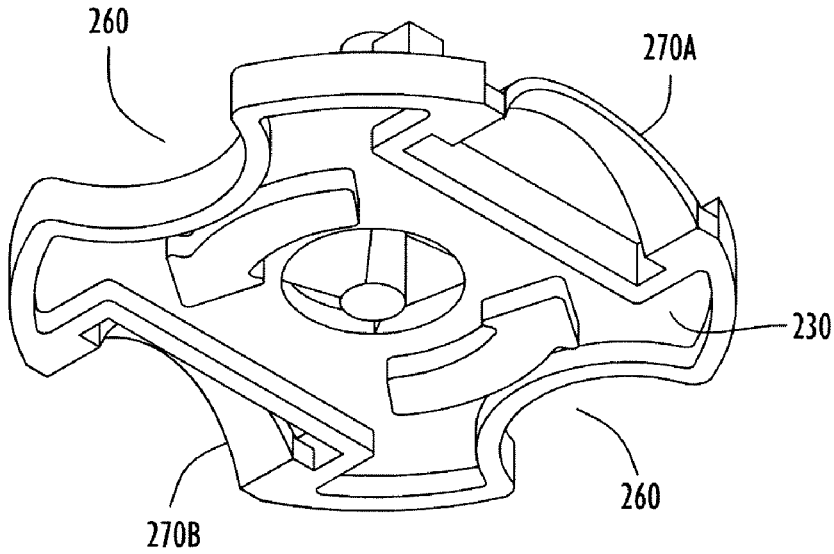

FIG. 1 illustrates and exploded view of a product fastening system in accordance with an embodiment of the invention. As illustrated, the system 100 includes a key or plug, a product support or platform 120, and a product 130. By way of example the system 100 may include one or more plugs 110A, 110B, 110C, each having a stem of a predetermined length. The plugs 110A-110C are configured to selectively secure the product 130 to the product support 120. Referring to FIGS. 2A and 2B (showing top and bottom views, respectively), the plug 110A includes a base 200 and a shaft or stem 210 extending distally from the base 200. The base 200 may be in the form of a plate or disk having a first or top surface 220 and a second or bottom surface 230. The shaft 210 may be disposed coaxially with the central axis of the base 200. The distal end 240 of the shaft may further include a first finger 250A and a second finger 250B collectively defining a keyed end of the shaft 210. The base 200 may further include one or more cut-out sections 260 configured to permit gripping of the base utilizing a users fingers. By way of example, the base 200 may include a pair of opposed, curved, cut-out sections 260 formed into the periphery of the base.

The plug 110A may further include one or more biasing members. In the embodiment of FIGS. 2A and 2B, the plug 110A may have a first spring 270A and a second spring 270B formed into the base 200. The springs 270A, 270B may be positioned along the base periphery such that the first spring 270A is oriented opposite the second spring 270B. The biasing members 270A, 270B apply a force to the product support 120 and/or the product 130 to increase the tension between the plug 110A-C and the product 130 (discussed in greater detail below). While a particular configuration spring is illustrated as the biasing member 270A, 270B, it should be understood other forms of the biasing member could be utilized such as a flat springs, coil springs, cantilevered springs, leaf springs, etc.

Figure 3:
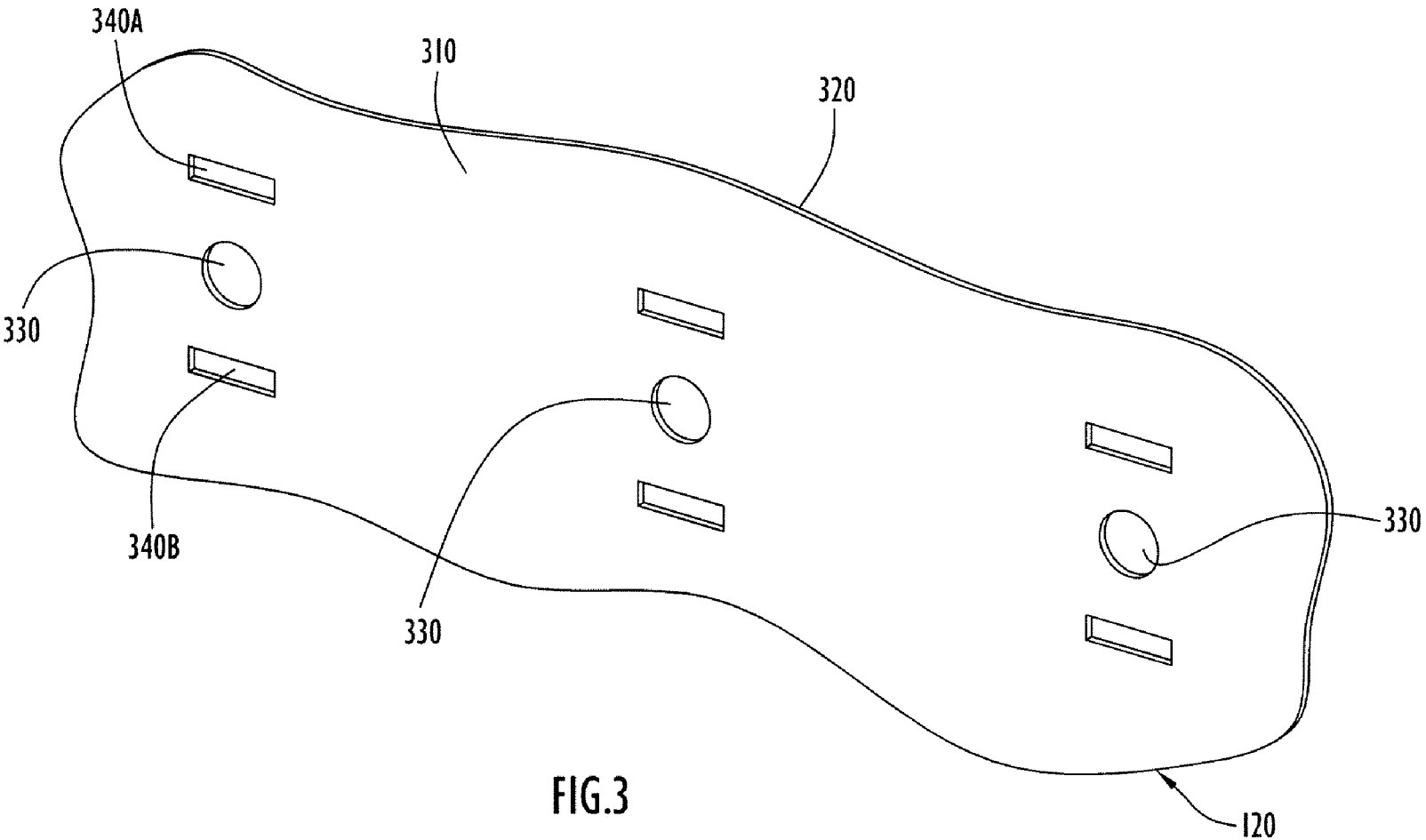
FIG. 3 illustrates a support platform in isolation, showing a close-up of the through-holes.

The product support or platform 120 provides a surface to which the product 130 may be secured. The product support 120 typically comprises a portion of product packaging, e.g., a wall or a display platform, to which the product 130 is secured. Referring to FIG. 3, the product platform 120 may be a generally planar element having a first or outer surface 310 and a second or inner surface 320. The planar member may include one or more key ports 330 configured to receive the keyed end of a respective plug 110A-110C. That is, the key port 330 possesses a shape and has dimensions suitable to permit the passage of the distal/keyed end 240 of the plug shaft 210, while preventing the passage of the base 200 therethrough. As illustrated, the port 330 may possess a generally circular shape having a diameter slightly larger than the diameter of the fingers 250A, 250B, to permit the fingers to pass therethrough.

The product support 120 may further include one or more receptacles or guide tracks configured to receive and/or orient the biasing members 270A, 270B on the plug 110A-C. By way of example, the product support 120 may include a first guide track 340A and a second guide track 340B oriented opposite the first guide track 340A, across the port 330 (i.e., each biasing member 270A, 270B may include an associate track 340A, 340B with which it mates). The structure of the guide track 340A, 340B may be any suitable for its described purpose. In the illustrated embodiment, the guide tracks 340A, 340B are each defined by a generally rectangular opening that permits a biasing member 270A, 270B to extend through or into the platform 120. Each guide track 340A, 340B is positioned and sized to receive a corresponding biasing member 270A, 270B, indicating the orientation of the plug 110A-C in either a locked or unlocked position (discussed in greater detail below). The product support 120 may be formed from any conventional packaging materials including, but not limited to, plastic, cardboard, wood, etc.

Figure 4A:
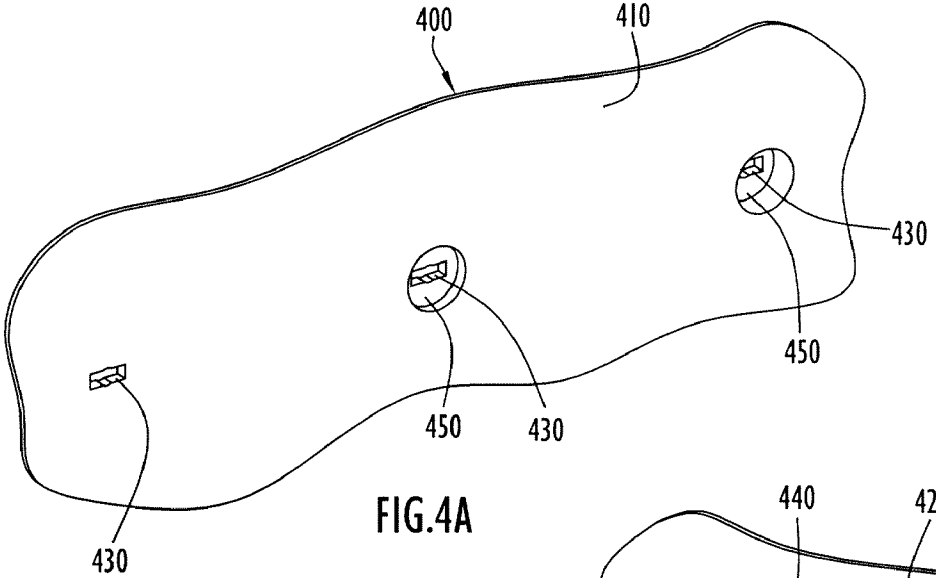
FIGS. 4A and 4B illustrate a portion of a wall forming the product if FIG. 1. Specifically.
Figure 4B:
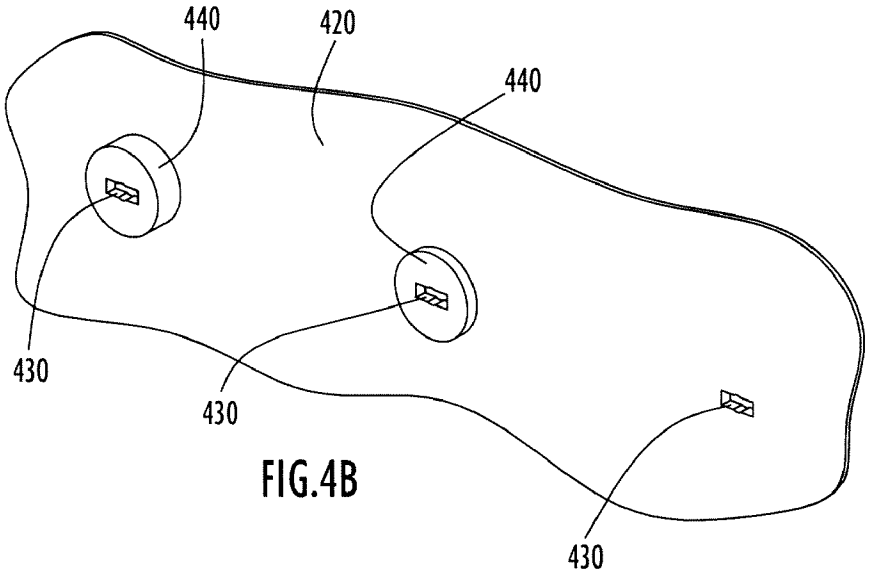

The product 130, e.g., a toy, is configured to selectively mate with the plugs 110A-C. Referring to FIGS. 4A and 4B, showing exterior and interior views the product 130, the product 130 includes a wall 400 having a first or exterior side 410 and a second or interior side 420. The wall 400 includes one or more keyholes 430 possessing a shape complimentary to that of the distal end 240 of each of the plugs 110A-C. In the embodiment illustrated in FIGS. 4A and 4B, the keyhole 430 is a generally elongated slot that receives the fingers 250A, 250B of the plug 110A-C when properly aligned with the slot. The keyhole 430 may be formed on a pedestal 440 extending distally from the interior surface 420 of the product wall 400.

The pedestal 440 may form a corresponding recessed area 450 along the exterior surface 410 of the product wall 400. The height of the pedestal 440 is not particularly limited, but is typically is sized to correspond with the length of the stem 210 extending form the base 200 of the plug (taking into account the thickness of the product wall 400 as well as the product support 130). By way of example, the pedestal 440 may have a height corresponding to the stem of plug 110A, or may have a height corresponding to the stem of plug 110B (FIG. 1). Alternatively or addition, no pedestal 440 may be formed into the product wall 400 to permit the keyhole 430 to be generally flush with the product wall 400. Note that for exemplary purposes, all three examples are shown in FIGS. 1, 4A, and 4B.

Figure 5A:
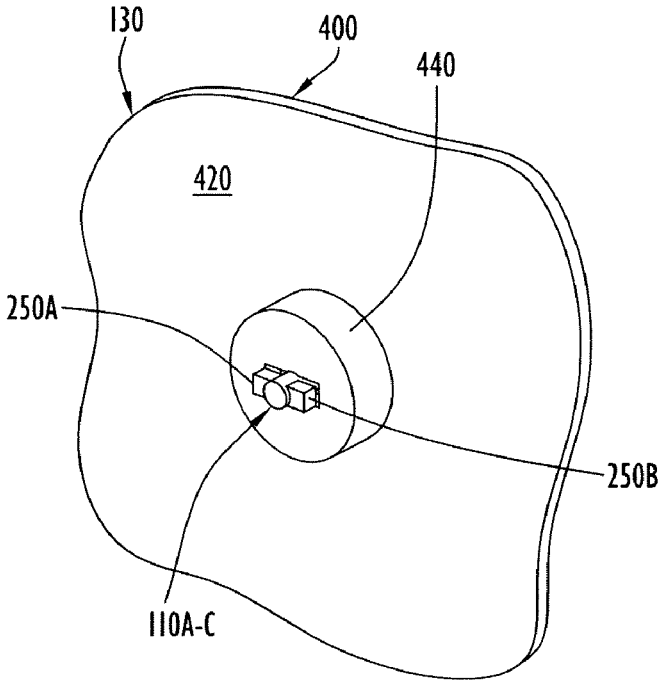
FIG. 5A illustrates an interior view of the product, showing the plug/key oriented in an unlocked position.
Figure 5B:
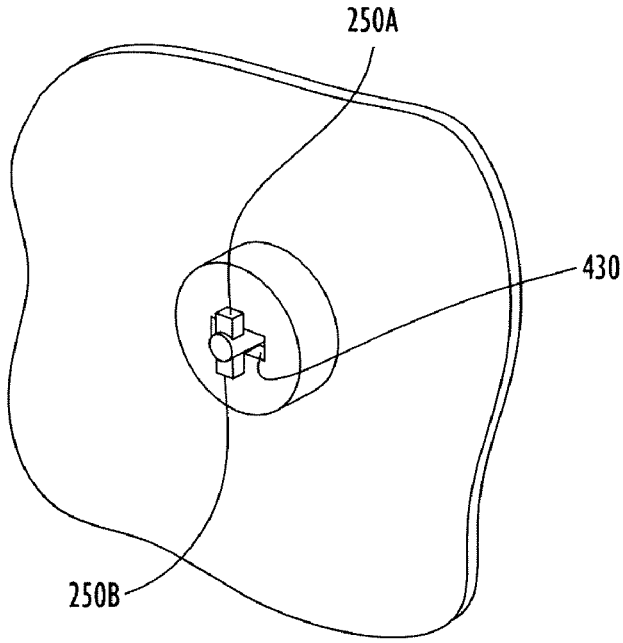
FIG. 5B illustrates an interior view of the product, showing the plug/key oriented in a locked position.

With this configuration, plug 110A-C selectively engages the keyhole 430 to secure the product 130 to the support 120. Referring to FIGS. 5A and 5B, the stem 210 of the plug 110A-C may be axially inserted into the port 330 of product support 120 and through the keyhole 430 formed in product 130. The plug 110A-C may then be selectively rotated from a first (unlocked) position (FIG. 5A), in which the fingers 250A, 250B of the plug generally align with the keyhole 430, to a second (locked) position (FIG. 5B), in which the fingers 250A, 250B of the plug 110A-C are not aligned with the keyhole 430. In the locked position of FIG. 5B, the plug 110A-C is secured to the product 130. To unlock the plug 110A-C and remove it from the keyhole 430, the plug 110A-C is simply rotated in the reverse direction until the fingers 250A, 250B of the plug 110A-C once again align with the slot of keyhole 430. The stem 210 of the plug 110A-C is then axially removed from the product 130.

The operation of a fastening system in accordance with the present invention is explained with reference to FIGS. 6A and 6B. FIG. 6A illustrates a cross-sectional view of the system in accordance with an embodiment of the invention. The product 130 is positioned on the second side 320 of the support platform 120, and the plug 110A-C is positioned on the first side 310 of the support platform. The port 330 of the support platform 120 is generally aligned with a keyhole 430 of the product 130, and the plug 110A-C is axially inserted through the port 330 of the support platform 120 and into the keyhole 430 of the product 130. The plug 110A-C may then be rotated to move the plug 110A-C (by gripping the cut-out sections 260) from the unlocked position to the locked position as described above.

Figure 6B:
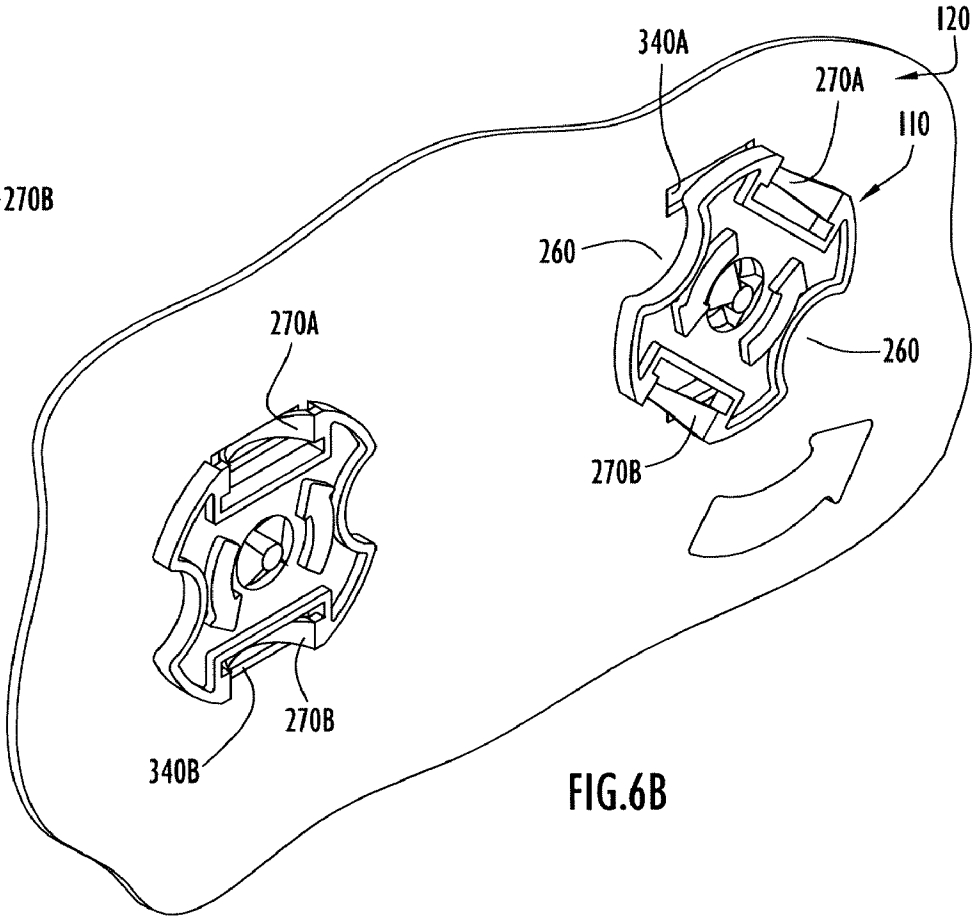
FIG. 6B illustrates a rear perspective view of the support platform, showing orientation of the plug in locked/unlocked positions.
Figure 6A:
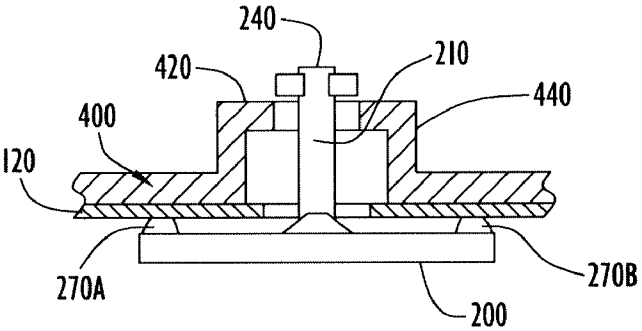
FIG. 6A illustrates a cross-sectional view of the product, showing the insertion of the key into the keyhole of the product.

Referring to FIG. 6B, illustrating a rear perspective view of the system, the plug 110A-C may be rotated utilizing finger cut-out sections 260 until the biasing members 270A, 270B align with the guide tracks 340A, 340B formed into the product support 120. The biasing members 270A, 270B and guide tracks 340A, 340B may be oriented such that mating of the biasing members with the guide tracks indicates the fingers 250A, 250B of the plug 110 are oriented in their misaligned/locked position with respect to the keyhole 430 of the product 130. The biasing members 270A, 270B apply a downward pressure (from the perspective of FIG. 6A) to the plug stem 210, drawing the distal end 240 of the stem downward, toward the interior surface 420 of the product wall 400. This, in turn, increases the frictional forces between the fingers of the plug 110A-C and the product 130, improving the connection of the product 130 to the product support 120. The biasing members 270A, 270B further function as shock absorbers, adjusting to movement of the packaging during transport and stabilizing the product 130.

To release the product 130 from the product support 120, the plug 110 is rotated to displace the biasing members 270A, 270B from the guide tracks 340A, 340B until the fingers 250A, 250B are once again axially aligned with the keyhole 430 of the product 130 as described above. The plug 110A-C may then removed from the product 130, which, in turn, may be removed from the support platform 120.

Figure 7A:
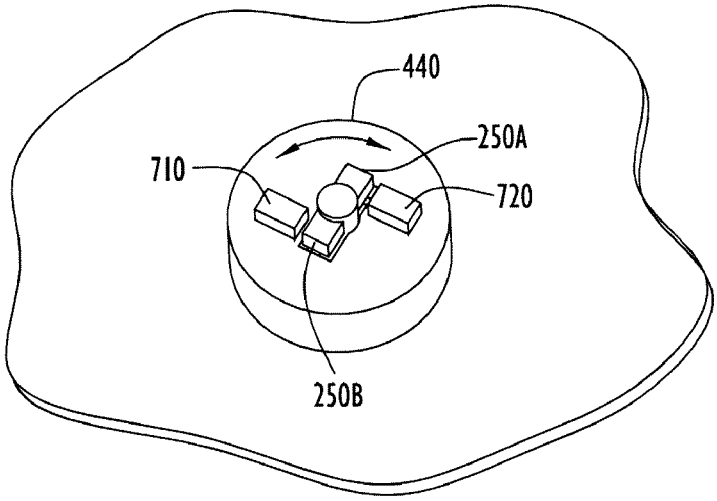
FIG. 7 illustrates a plug/key in accordance with another embodiment of the present invention.
Figure 7B:
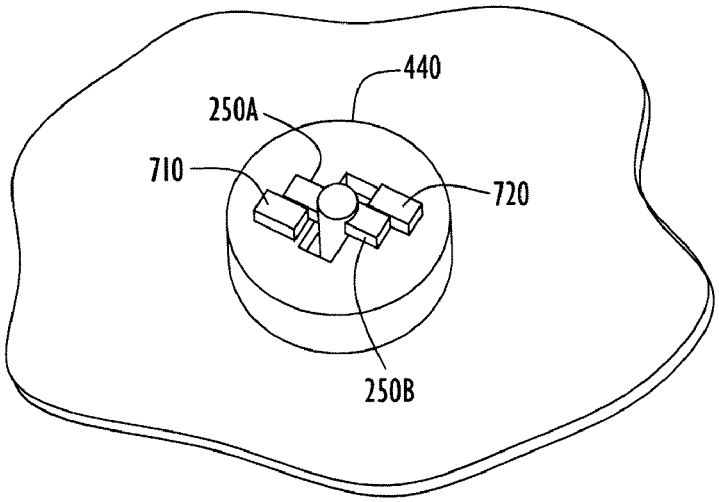

FIGS. 7A and 7B illustrate a fastening system in accordance with another embodiment of the present invention. As illustrated, the pedestal 440 may include one or more stops to prevent over rotation of the plug 110A-C, as well as to signal to the user that the plug 110A-C is in its locked position. Referring to FIG. 7A, the pedestal 440 may include a first boss 710 and a second boss 720 opposed from the first boss across the keyhole 430. In operation, as shown in FIG. 7B, the plug 110A-C may be inserted into the keyhole 430 and rotated until the fingers 250A, 250B of the plug 110A-C contact the bosses 710, 720. The bosses 710, 720, then, prevent over rotation of the plug 110A-C.

The shaft 210 and fingers 250A, 250B of the plug 110A-C may also configured to prevent the formation of small parts. A "small part" is any object that fits completely into a specially designed test cylinder (2.25 inches long by 1.25 inches wide) that approximates the size of the fully expanded throat of a child under three years old. This specialized definition applies to (1) a whole toy or article, (2) a separate part of a toy, game, or other article, or (3) a piece of a toy or article that breaks off during testing that simulates use or abuse by children. If a "small part" fits completely into the specially designed test cylinder, and the toy or product from which it came is intended for use by children under three years of age, the toy or product is banned because the small part presents a choking hazard.

Thus, toys and products intended for use by children less than three years of age must not release pieces that fit completely into the small parts cylinder after impact, flexure, torque, tension and compression testing. These tests simulate the forces that toys and products can/may experience during normal use and abuse by children less than three years of age. If these forces cause parts to break off that fit in the small parts cylinder, those parts are deemed to present a risk of choking, aspiration, or ingestion to children less than three years of age.

Figure 8:
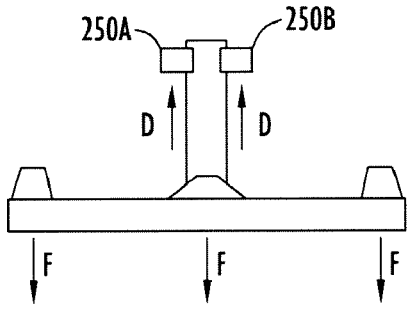
FIG. 8 illustrates a side perspective view of a key/plug in accordance with the present invention, indicating the application of shear forces thereon.

For this reason, the fingers 250A, 250B of the plug 110A-C are configured to plastically deform when a pressure of at least about 48-56 lbs. is applied to the plug 110A-C. That is, referring to FIG. 8, the fingers 250A, 250B of the plug 110A-C are resilient, thus they tend to flex whenever a downward force is applied to the plug 110A-C (as indicated by arrows F). As a result, should the plug 110A-C be oriented in its locked position when a user attempts to draw the plug out of the keyhole 430 with a force of at least about 48-56 lbs., the fingers 250A, 250B will plastically deform upward (in a direction D which is opposite to the force F) and remain intact (i.e., the fingers 250A, 250B plastically deform to permit removal of the plug 110A-C from the keyhole 430, but do not do not break off of the shaft 210), preventing the potential for formation of small parts as explained above. Many different materials may be utilized to form the shaft 210 and the fingers 250A, 250B of the plug 110A-C, such as different kinds of plastic and thermoplastics (such as ABS (acrylonitrile butadiene styrene), PPR (polypropylene resin), styrene, nylon, etc.). However in one preferred embodiment, the shaft 210 and the fingers 250A, 250B of the plug 110A-C are formed from PPR and shaped such that when a user attempts to draw a locked plug 110A-C out of the keyhole 430 with a force of at least about 48-56 lbs., the fingers 250A, 250B will plastically deform upward (in a direction D which is opposite to the force F) and remain intact.

Figure 9A:
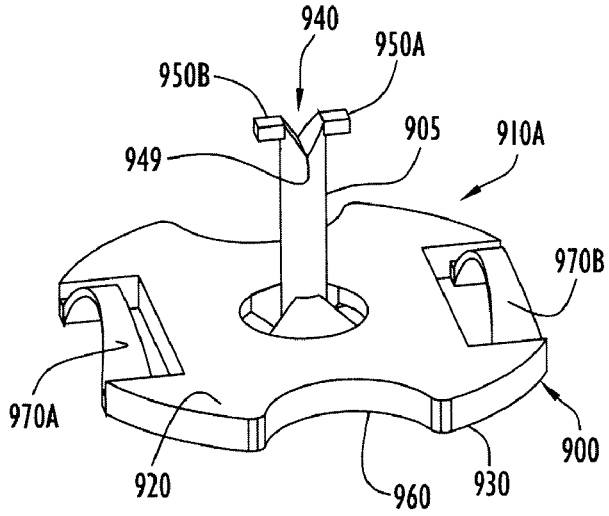
FIGS. 9A and 9B illustrate additional plugs in accordance with a further embodiment of the present invention. Specifically.
Figure 9B:
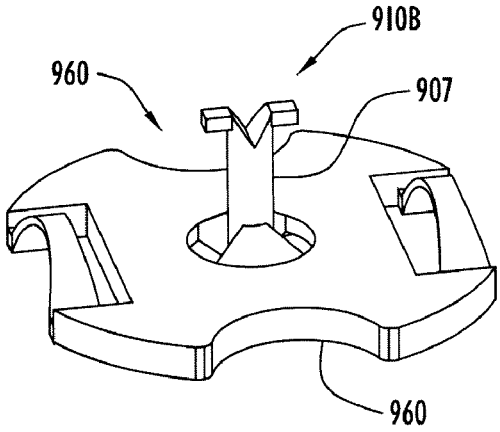
Figure 10:
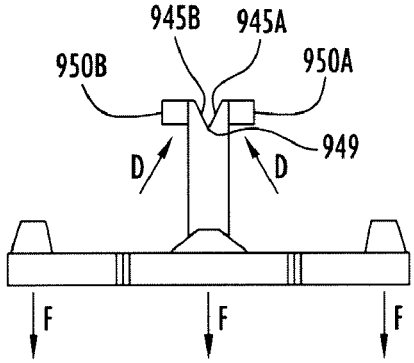
FIG. 10 illustrates a side perspective view of the key/plug of either FIG. 9A or 9B in accordance with the present invention, indicating the application of shear forces thereon.

Referring to FIGS. 9A and 9B, the plug 910A includes a base 900 and a shaft or stem 905 extending distally from the base 900. The base 900 may be in the form of a plate or disk having a first or top surface 920 and a second or bottom surface 930. The shaft 905 may be disposed coaxially with the central axis of the base 900. The distal end 940 of the shaft 905 may further include a first finger 950A and a second finger 950B collectively defining a keyed end of the shaft 905. The distal end 940 of the shaft 905 may further include canted surfaces 945A and 945B (see FIG. 10) which meet at intersection line 949. The base 900 may further include one or more cut-out sections 960 configured to permit gripping of the base 900 utilizing a users fingers. By way of example, the base 900 may include a pair of opposed, curved, cut-out sections 960 formed into the periphery of the base.

The plug 910A may further include one or more biasing members. In the embodiment of FIGS. 9A and 9B, the plug 910A may have a first spring 970A and a second spring 970B formed into the base 900. The springs 970A, 970B may be positioned along the base periphery such that the first spring 970A is oriented opposite the second spring 970B. The biasing members 970A, 970B apply a force to the product support 120 and/or the product 130 to increase the tension between the plug 910A and the product 130 (discussed in greater detail above). While a particular configuration spring is illustrated as the biasing member 970A, 970B, it should be understood other forms of the biasing member could be utilized such as a flat springs, coil springs, cantilevered springs, leaf springs, etc. Note that the plug 910B of FIG. 9B is almost identical to the plug 910A of FIG. 9A in every respect. However, the shaft 907 of the plug 910B is shorter than the shaft 905 of plug 910A to accommodate different products or packaging.

As referenced above, toys and products intended for use by children less than three years of age must not release parts/pieces that fit completely into the small parts cylinder after impact, flexure, torque, tension and compression testing. Such testing simulates the forces that toys and products can/may experience during normal use and abuse by children less than three years of age. If these forces cause parts/pieces to break off that fit in the small parts cylinder, those parts/pieces are deemed to present a risk of choking, aspiration, or ingestion to children less than three years of age.

For this reason, the fingers 950A, 950B of the plug 910A-B are configured to deform when a pressure of at least about 20 lbs. is applied to the plug 910A-B. That is, referring to FIG. 10, the fingers 950A, 950B of the plug 910A-B are resilient, thus they tend to flex inward towards each other along intersection line 949 whenever a downward force is applied to the plug 910A-B (as indicated by arrows F). As a result, should the plug 910A-B be oriented in its locked position when a user attempts to draw the plug out of the keyhole 430 with a force of at least about 20 lbs., the fingers 950A, 950B will deform upward and inward towards each other along intersection line 949 (in a direction D which is generally opposite to the force F) and remain intact (i.e., the fingers 950A, 950B deform to permit removal of the plug 910A-B from the keyhole 430, but do not do not break off of the shaft 905, 907), preventing the potential for formation of small parts as explained above. Thus, the geometry of the fingers 950A, 950B and intersection line 949 is such that if a force of 15 lbs. is applied in direction F, the fingers 950A, 950B will prevent the plug 910A-B from being removed from the keyhole, but when the force is increased to at least about 20 lbs., the fingers 950A, 950B will deform upward and inward towards each other along intersection line 949 and remain intact (i.e., the fingers 950A, 950B deform to permit removal of the plug 910A-B from the keyhole 430, but do not do not break off of the shaft 905, 907), preventing the potential for formation of small parts.

While the invention has been described in detail and with reference to specific embodiments thereof, it will be apparent to one skilled in the art that various changes and modifications can be made therein without departing from the spirit and scope thereof. For example the base 200, 900 may possess any shape and have any suitable dimensions. Though a generally circular, disc-shaped base 200, 900 is illustrated, other shapes may be utilized, including but not limited to polygons. The biasing members 270A, 270B, 970A, 970B may be any suitable for their described purpose. The support platform 120 may be formed of any suitable materials, possess any suitable dimensions, and have any suitable shape. Similarly, the port 330 and the guide tracks 340A, 340B may possess any shape of have any dimensions suitable for their described purposed. For example, while a guide track is shown in the figures to be an opening (a pass-through), a guide track may also be defined by a recessed area or notch formed into the support platform 120. The pedestal 440 may possess any suitable shape and have any suitable dimensions. Specifically, the height of the pedestal 440 may be any suitable for its described purpose.

Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A package assembly for a toy, the package assembly comprising:

a support platform for supporting the toy, the support platform including:

a first surface, a second surface, and a pass through extending from the first surface to the second surface;

a toy including a keyhole; and a plug configured to be inserted into the keyhole, the plug comprising:

a base, a shaft extending distally from the base, the shaft having a distal portion and a proximal portion, wherein the shaft defines a shaft axis, a first prong extending from the distal portion of the shaft, the first prong being positioned transversely with respect to the shaft axis, and a second prong extending from the distal portion of the shaft, the second prong being positioned transversely with respect to the shaft axis, wherein a shaft distal end includes a first canted surface a second canted surface that cooperate to define a notch along the shaft distal end, and wherein the notch enables flexure of the first prong toward the second prong.

2. The package assembly of claim 1, wherein the plug includes at least one integrally-formed biasing member operable to generate a biasing force with respect to the toy.

3. The package assembly of claim 2, wherein the at least one biasing member applies a biasing force toward the proximal portion of the shaft.

4. The package assembly of claim 2, wherein the at least one biasing member comprises an integrally-formed spring.

5. The package assembly of claim 4, wherein the spring comprises a generally arcuate spring.

6. The package assembly of claim 1, wherein the base further comprises a gripping member to permit manipulation of the plug.

7. The package assembly of claim 6, wherein the gripping member comprises a cut-out section formed into the base of the plug.

8. The package assembly of claim 2, wherein the support platform further includes a guide track operable to receive the at least one biasing member and indicate to a user that the prongs are disposed in a predetermined position with respect to the toy.

9. The package assembly of claim 1, wherein:

the toy contacts the first surface of the support platform;

the plug is axially inserted into the pass-through and the keyhole; and at least one of the prongs is oriented such that it is misaligned with the keyhole thereby locking the toy to the support platform.

10. The package assembly of claim 9, wherein a biasing member engages the second surface of the support platform to apply a force sufficient to draw at least one of the prongs into mechanical contact with the toy, and to draw the toy toward the base of the plug.

11. The package assembly of claim 9, wherein:

the toy includes a wall having a pedestal extending distally from the wall; and the keyhole is disposed along a distal end of the pedestal.

12. The package assembly of claim 1, wherein:

the toy further comprises an interior surface, an exterior surface, and a guide tab formed on the interior surface of the toy; and the guide tab is configured to engage at least one of the prongs to prevent the rotation of the plug beyond a predetermined rotational position.

13. The package assembly of claim 1, wherein:

the canted portions meet at an intersection line proximate the distal end of the shaft; and the first and second prongs are configured to move towards one another along the intersecting intersection line but remain attached to the plug when a force of at least about 20 pounds is applied to the plug to pull the plug and prongs from a misaligned position with respect to the keyhole.

14. The package assembly of claim 13, wherein the at least one of the first prong and the second prong is formed from a plastic material.

15. A method of orienting a toy in packaging, the method comprising:

(a) providing a toy supporting platform including a first surface, a second surface, and a through-hole extending from the first surface to the second surface;

(b) providing a plug including:

a base, a shaft extending distally from the base, the shaft having a distal portion and a proximal portion, wherein the shaft defines a shaft axis, a first prong extending from the distal portion of the shaft, the first prong being positioned transversely with respect to the shaft axis, and a second prong extending from the distal portion of the shaft, second prong being positioned transversely with respect to the shaft axis, wherein a shaft distal end includes a first canted surface a second canted surface that cooperate to define a notch along the shaft distal end, and wherein the notch enables flexure of the first prong toward the second prong;

(c) providing a toy including a keyhole configured to receive the shaft of the plug;

(d) orienting the toy on the supporting platform such that the through-hole aligns with the keyhole;

(e) axially inserting the distal end of the shaft into the through-hole and the keyhole such that at least one of the prongs is positioned within the toy; and (f) rotating the plug to orient the at least one prong from a first position, in which the at least one prong is permitted to exit the toy, to a second position, in which the at least one prong is retained within the toy.

16. The method of claim 15, wherein the base includes at least one biasing member operable to apply a biasing force and:

(d) comprises (d.1) orienting the toy on the first surface of the supporting platform and (d.2) orienting the plug on the second surface of the supporting platform; and (f) further comprises rotating the plug to orient at least one of the prongs in the second position locking the toy to the supporting platform.

17. The method of claim 16, wherein:

the toy supporting platform further includes a guide track operable to receive the at least one biasing member and to indicate at least one of the prongs is in a predetermined position; and (f) further comprises rotating the plug from the first position, in which the at least one biasing member is not seated in the guide track, to a second position, in which the at least one biasing member is seated in the guide track.

18. The method of claim 15, wherein:

the toy further comprises an interior surface, an exterior surface, and a guide tab formed on the interior surface of the toy;

the guide tab is configured to engage at least one of the prongs and prevent the rotation of the plug beyond a predetermined position; and (f) further comprises rotating the plug until the at least one prong contacts the guide tab.

19. The method of claim 15, wherein:

the canted surfaces intersect along an intersection line proximate the distal end of the shaft; and the canted surfaces move towards one another along the intersection line; and the prongs remain attached to the plug when a force of at least about 20 pounds is applied to the plug to pull the plug from the second position.

20. A package assembly comprising:

a toy including a keyhole;

a support platform for supporting the toy, the support platform including a first surface, a second surface, and a pass through extending from the first surface to the second surface; and a plug configured to be inserted into the keyhole, the plug comprising:

a base, a shaft extending distally from the base, the shaft having a proximal shaft section and a distal shaft section, wherein the shaft includes a central shaft axis, a first prong disposed along the distal shaft section, the first prong including a transverse prong portion positioned transversely with respect to the shaft central axis and a canted prong portion extending from the transverse prong portion to the shaft, and a second prong disposed along the distal shaft section, the second prong including a transverse prong portion positioned transversely with respect to the shaft central axis and a canted prong portion extending from the transverse prong portion to the shaft, wherein the canted prong portions define a notch along a shaft distal end, the canted prong portions meeting along an intersection line disposed along the bottom of the notch, and wherein the prongs are configured to flex towards the shaft central axis along the intersection line.

* * * * *